United States Patent [19]

Anderson

[11] 4,242,836

[45] Jan. 6, 1981

[54] ENERGY CONSERVING SECURITY SHUTTERS

[76] Inventor: Harold E. Anderson, 1460 E. River Rd., Grand Island, N.Y. 14072

[21] Appl. No.: 930,425

[22] Filed: Aug. 2, 1978

[51] Int. Cl.[2] ..... E06B 9/00

[52] U.S. Cl. ..... 49/63; 49/370

[58] Field of Search ..... 49/62, 63, 61, 370, 49/366, 362; 52/207; 160/90, 91, 96, 102, 104, 127, 197, 202

[56] References Cited

U.S. PATENT DOCUMENTS

| | | | |
|---|---|---|---|
| 2,841,834 | 7/1958 | Poole, Jr. | 52/207 |
| 3,452,477 | 7/1969 | Sassano | 49/362 X |
| 4,057,936 | 11/1977 | Wyatt, Sr. et al. | 49/61 |
| 4,083,148 | 4/1978 | Saucier | 49/63 X |

*Primary Examiner*—Kenneth Downey

*Attorney, Agent, or Firm*—Raymond F. Kramer

[57] ABSTRACT

An energy conserving shutter assembly for the inside of a window for securely additionally closing a window opening in a building so as to insulate the window further and inhibit air leakage past it includes upper and lower track members and a sliding shutter slidable in and between said tracks to open and closed positions, in the closed position of which the shutter closes off said window and maintains an insulating dead air space about it. In preferred embodiments of the invention a pair of shutters is present and is employed cooperatively, sealing means are provided between the shutters, the track and a window frame to inhibit air leakage, the shutters, sealing means and tracks are of thermally non-conductive material(s) and draping members are fastened to and cover the shutters, providing additional insulation.

10 Claims, 8 Drawing Figures

ENERGY CONSERVING SECURITY SHUTTERS

This invention relates to insulating shutters. More particularly, it relates to interior slidable shutters for installation about a window to better insulate such window, inhibit air leaks through it and provide improved security against criminal entry to premises through such window.

Shutters, both exterior and interior, have long been employed for both protective and decorative purposes. Shutters of the familiar swinging and folding types, hooked or bolted together along a line of contact, are well known. Sliding windows and doors employing horizontal tracks are also known. The use of weatherstripping for making airtight and watertight seals about certain sliding window parts has been disclosed, as has been the desirability of minimizing air leakage so as to conserve heating (or cooling) energy.

U.S. Pat. Nos. 3,321,234 and 4,004,373 illustrate horizontal track sliding windows, with the latter patent teaching the employment of weatherstripping to make an airtight and watertight seal about the window. U.S. Pat. No. 3,483,658 discloses resilient foam strips in a framing member against which a movable window makes contact. Such foam strips, together with more conventional weatherstripping provided in channel 17 of such windows of the patent, help to prevent infiltration of air through the window assembly. U.S. Pat. No. 4,012,980 describes a storm window which is assembled to a prime window by means of a metallic frame including U-shaped channels, which frame includes a fourth side fastened in place after installation of the storm window. U.S. Pat. No. 4,068,428 discloses the concept of mounting insulating means (a window) on an interior window frame. Although the prior art discloses sliding windows, channel framing for sliding windows, interior window covers to prevent energy loss and air leakage and weatherstripping and foam insulation for use in window installations, it does not teach sliding interior shutters of the structure of those of this invention nor does it suggest various advantages thereof described in this specification.

In accordance with the present invention a sliding shutter assembly for insulating a window and for securely closing a window opening about such window comprises upper and lower track members, at the top and bottom of the window, respectively, and a sliding shutter slidable in said members to open and closed positions, in the opened position of which access may be had between the shutters to the window and in the closed position of which the shutter closes off said window and maintains an insulating dead air space about it. In preferred embodiments of the invention a pair of matching shutters is employed rather than a single shutter, sealing means are provided to inhibit air leakage between the shutters, tracks and window frame when the shutters are closed, the shutters, sealing means and tracks are of thermally non-conductive material(s) and non-conductive drapes are fastened to and cover the shutters, providing additional insulation.

The invention, its operation and various advantages thereof will be readily understood from this description, taken in conjunction with the drawing in which.

Figure 1:
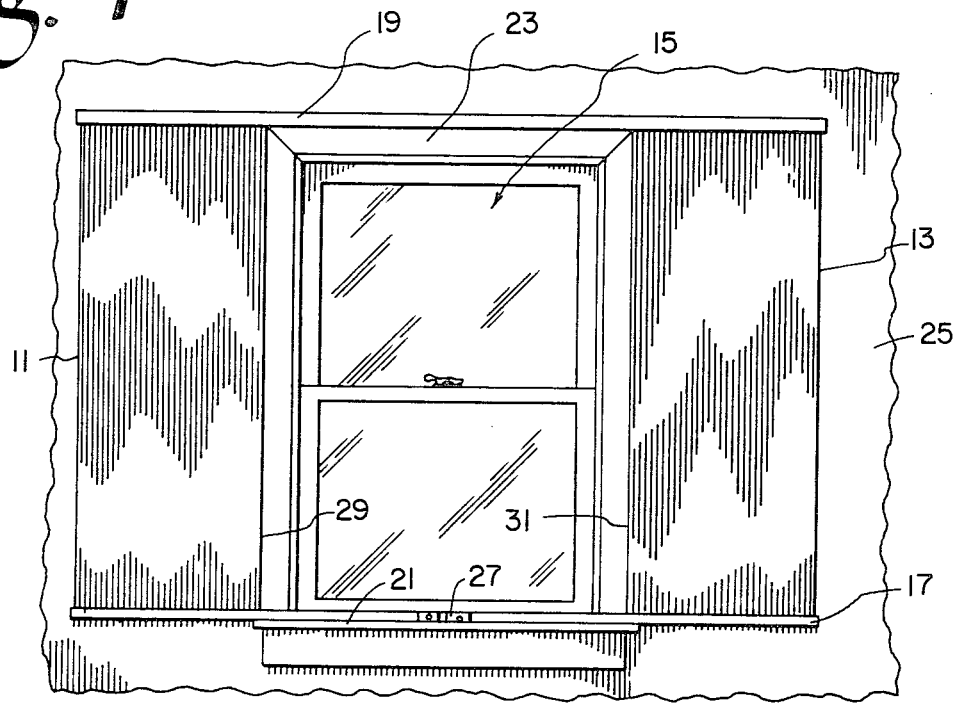
FIG. 1 is a side elevational view of the interior of a window installation, including tracks, shutters and locking means of this invention, with the shutters in open position.

In FIG. 1 insulating shutters 11 and 13, shown in open position about window 15, are mounted in tracks 17 and 19 which, in turn, are mounted on sill 21 and lintel or upper framing member 23, respectively. Additionally or instead, the track members may be mounted on wall 25 in which window 15 is set. Fastening or locking means 27, shown in greater detail in FIG. 4, are capable of holding shutters 11 and 13 locked in closed position, preferably with resilient sealing surfaces 29 and 31 thereof in contact with each other, for greater insulating and energy conserving effectiveness and for improved security.

Figure 2:
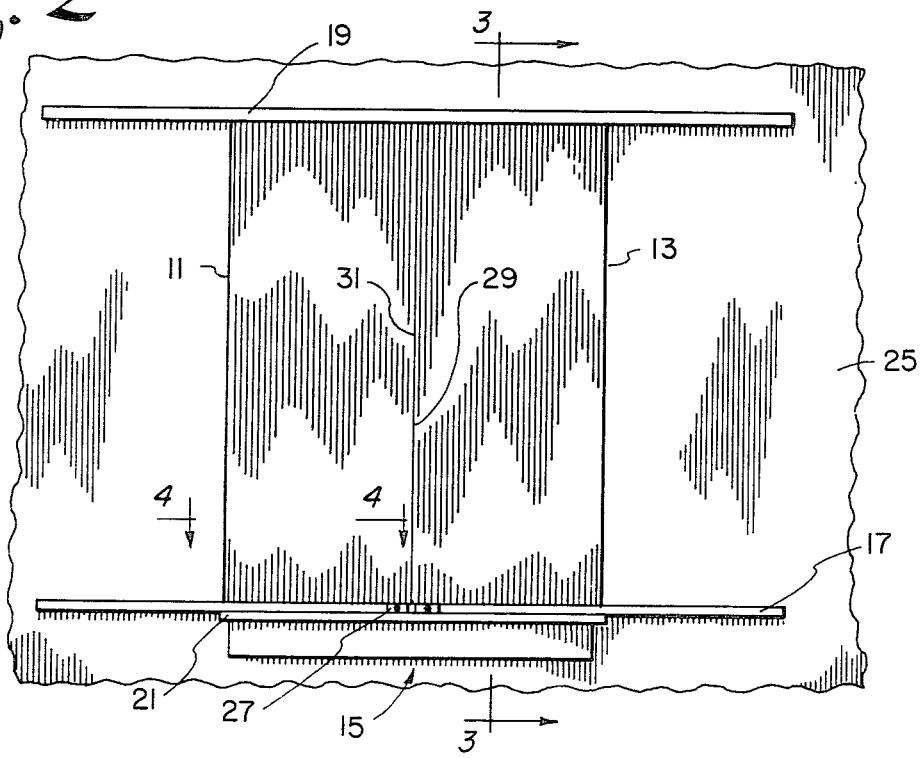
FIG. 2 is a view corresponding to FIG. 1 but with the shutters in closed position.

In FIG. 2 shutters 11 and 13 are shown in closed position, with "forward" sides 29 and 31 thereof in contact, held together by locking mechanism 27, preferably with at least one resilient insulating strip, joined to one (or a plurality may be joined to both) of sides 29 and 31 of shutters 11 and 13, respectively. Alternatively, the shutters may be grooved or otherwise shaped so as to interfit and thereby help to inhibit air leakage and energy loss between them when they are in closed position.

Figure 3:
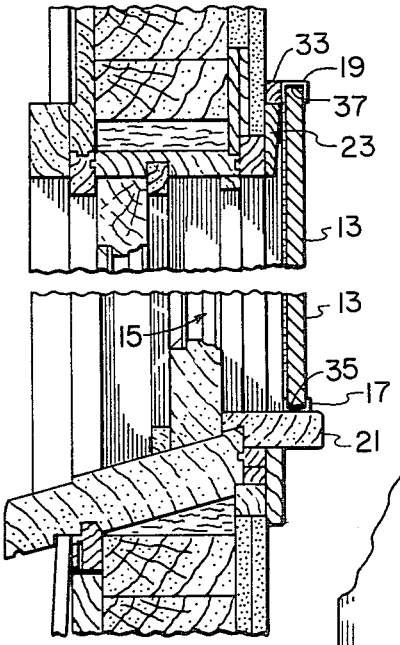
FIG. 3 is an enlarged partial sectional view along plane 3—3 of FIG. 2.
Figure 3:
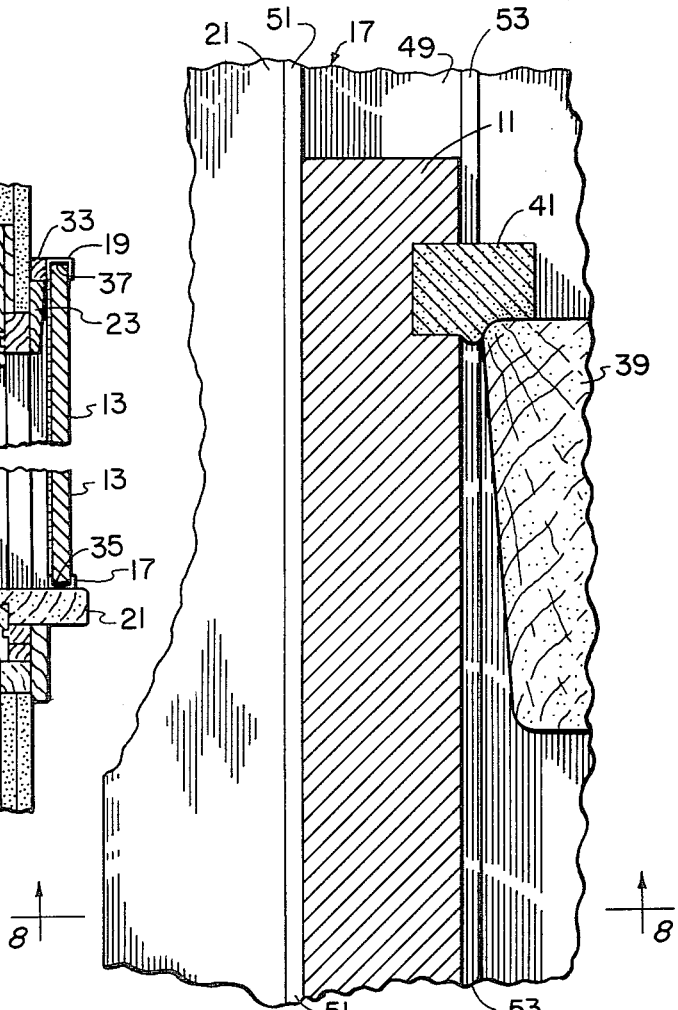

In FIG. 3 a conventional window structure is illustrated, identified by numeral 15, as in FIGS. 1 and 2. Because the internal parts shown, with few exceptions, are conventional for this type of window, mounted on a shingled or clapboarded wood house having conventional sheathing and interior wallboard therein, specific numerals will not be applied to parts of the window not relevant to the inventive aspects. Tracks 17 and 19 are appropriately mounted on sill 21 and filler strip 33 (behind top framing 23), respectively, as by screws (not shown) through the track bottom and wall, respectively. The filler strip, in turn, is mounted to framing 23 and/or the wall. Shutter 13 rides between tracks 17 and 19, with insulating means, such as resilient material, e.g., rubber stripping or synthetic organic polymeric foam, at 35 and 37 respectively, in the track between it and the shutter.

Figure 4:
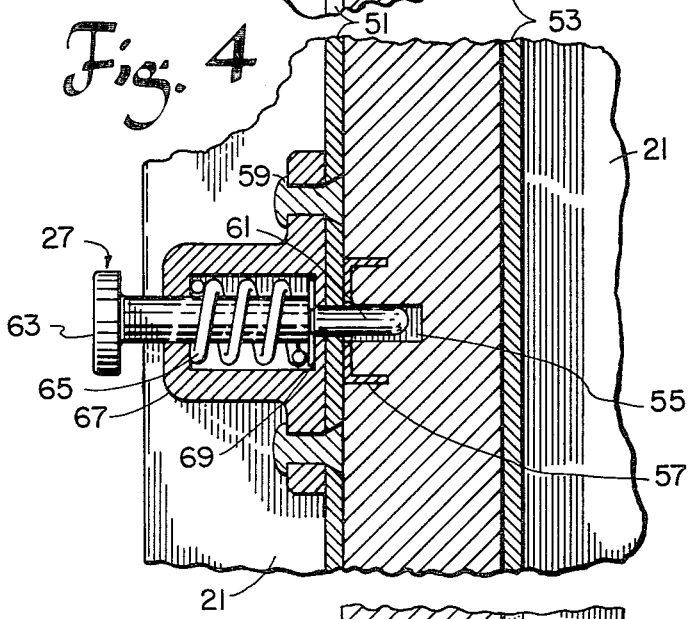
FIG. 4 is an enlarged partial sectional view along plane 4—4 of FIG. 2.

FIG. 4, a partial plan section, including end and middle portions of a shutter 11, shows details of locking mechanism 27 and means 41 for sealing the shutter in closed position against a vertical window frame portion 39. Locking means 27, a spring-loaded pin, for engagement with a toothed ferrule installed in shutter 11, includes housing 67 having within it spring means 65 for normally holding pin portion 61 in extended position, as illustrated, by pressing plate 69, connected to head 63 by an appropriate shaft, against the confines of the housing interior. Housing 67 is held in position against near vertical wall 51 of channel or track 17 by rivets 59 or other suitable fastener(s). Ferrule portion 55, of tooth-skirted grommet or similar bracket or part 57, suitably snuggly fits pin 61 so as to hold a shutter locked and sealed when it is in closed position. To release locking mechanism 27 and allow movement of the shutter to open position one needs only pull head 63 in such manner as to compress spring 65 sufficiently that pin 61 will clear grommet 57, ferrule 55 and the shutter. Although not illustrated, a plurality of other ferrule grommets may also be installed (or holes may be drilled in the shutter) so as to provide for fixed or ascertainable open, half-open and any other desired positions of the shutter and to hold it in such places. Similarly, pluralities of locking mechanisms such as those illustrated or equivalents thereof may be provided for each shutter although usually one per shutter is satisfactory.

Resilient sealing means 41, preferably a closed cell polyurethane foam, although open celled and other suitable resilient foams, elastomeric materials and seals may also be utilized, is shown inserted in an appropriate cavity or recess in the back or far major wall of shutter 11. Preferably the sealing means is strongly and permanently fastened in place on/in the shutter and extends beyond it a sufficient distance backward (away from the occupant of the room) by the window on which the shutter is installed, so as to contact and resiliently press against vertical window framing member 39 and prevent air leakage between the shutter and such member(s). Of course, a similar seal is provided against a corresponding framing member near the end of cooperating shutter 13. Instead of the seal being on the shutter, it may be on the window framing members of the types described and instead of the seal being with respect to the end portion of the framing member it may be between the front thereof and the shutter back, between the front of the framing member and the shutter end or between the end of the framing member and the shutter end. However, of the seal types mentioned that illustrated is preferred because it is most effective and is subject to repeated uses without premature failure.

Figure 5:
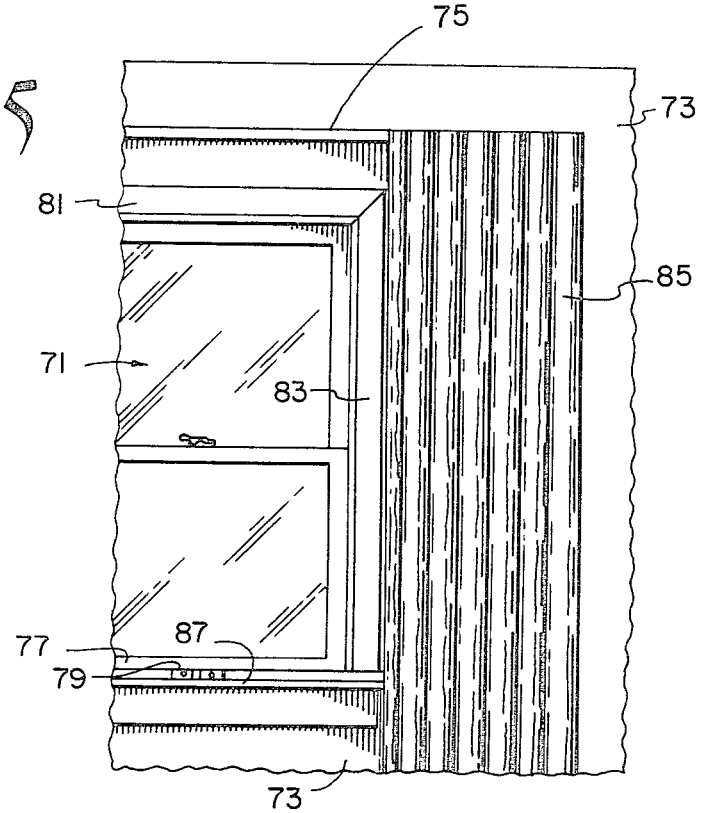
FIG. 5 is a side elevational view substantially corresponding to a part of FIG. 1 but showing a raised upper track for the shutters and showing a drapery member fastened to and covering a shutter.

In FIG. 5, which corresponds to a side of the installation or assembly of FIG. 1, with the upper track being raised and with a drapery member being held to and covering the shutter, window 71 is shown set in wall 73, with an upper track 75 mounted on said wall and a corresponding lower track, having locking means 79, being mounted on sill 87 and partially covering a lower portion of lower window sash 77. As shown, the right hand shutter, onto which drapery material is held on the surface thereof facing the room, in the form of drapery member 85, is in open position, with upper and right side window frame portions 81 and 83, respectively, and sill 87 being exposed. However, the drapery covered shutters are slidable, like the shutters of FIG. 1, to closed position, covering the window (as shown in FIG. 2). The material of the drapery members is preferably thermally non-conductive and such non-conductive drapes, fastened to and covering the shutters, provide insulation, in addition to performing their ornamental and concealing functions.

Figure 8:
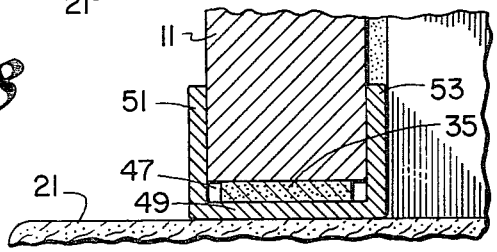
FIG. 8 is an enlarged partial sectional view along plane 8—8 of FIG. 4.

In FIG. 8 resilient sealing and cushioning means 35 are shown in position in track 17, fastened to sill 12 by means not shown (screws, nails, adhesives or other suitable fasteners). Clearance space 47 is shown between cushion member 35 and side wall 51 and a similar clearance is illustrated between the cushion and the other side wall 53. Although such clearances are desirable and allow lateral expansion of the seals, it is within the invention to omit them. The sealing member is cemented or otherwise held in place against the track bottom 49. A similar seal may be installed against the top surface of track 19 and preferably such seals will be of sufficient resilience so that both press against the matching surfaces of the shutters and prevent air leakages therebetween. If desired, additional sealing means may be present between the shutter sides and the interior vertical walls of tracks 17 and 19, too. Desirably the seals will have surfaces thereof that contact the shutter (subject to sliding motion) of smoother and more resistant (to tearing) flexible or resilient material than the main bodies of the seals.

Figure 6:
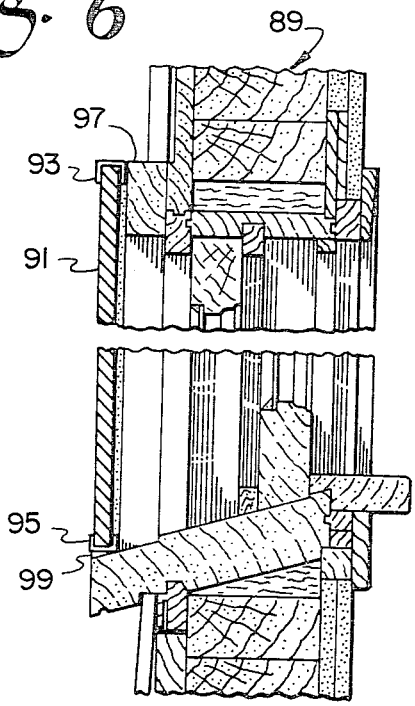
FIG. 6 is a view corresponding essentially to that of FIG. 3 but showing exterior installation of a pair of sliding shutters of this invention instead of interior installation.

In FIG. 6 upper and lower horizontal tracks 93 and 95, respectively, are installed on window structure 89, with the upper track being held to horizontal framing portion 97 and the lower track being held to a similar member and being further supported by putty, caulking or shim member 99 between the track and a sloped exterior sill member. Shutter 91, riding between tracks 93 and 95, may be appropriately sealed at the ends thereof and in an intermediate position against the matching shutter in the same tracks in the manner previously described with respect to the shutters of FIGS. 2–4 and 8. However, the various seals made should be suitable for external conditions to which they may be subjected. Other modifications in the shutters and tracks may be made to compensate for exterior installations. For example, the locking mechanism may be desirably adapted for internal operation (through an opened window). The main advantages of the invention are with respect to interior installations but various aspects of such installations may also be applicable to exterior shutters and so they have been mentioned and at least partially illustrated herein.

Figure 7:
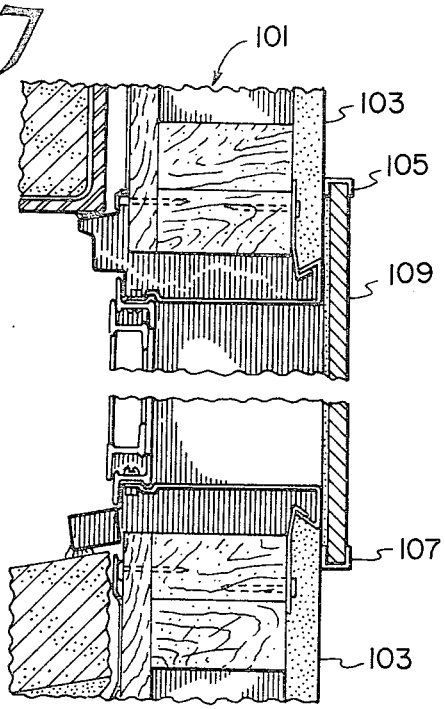
FIG. 7 is a partially sectioned view in elevation of a shutter installation of this invention on a metal frame window wherein the building structure is of concrete block or brick.

A flush installation, like that of FIG. 6, is also shown in FIG. 7, with the one-piece metal window frame type installation 101 being in a brick or cement block wall. Upper and lower tracks 105 and 107, respectively, are shown installed on plaster board or plaster wall 103 with shutter 109 between them. Of course, as with the other installations, a pair of shutters is preferably employed, although it is possible to utilize a single shutter or more than two shutters running in the same tracks and held together in closed position, when desired, by additional locking means. Although not shown it is also within the invention to utilize intentionally removable stops at the ends of the tracks to prevent accidental removals of the shutters when they are being opened.

The advantages of the present invention are to a large extent self-evident from the previous description. It provides a simple, desirably ornamental means for readily improving energy conservation by preventing thermal losses through one of the areas where heat is often lost, windows. With a few tools and a small amount of time the homeowner may install the apparatus of this invention. It is capable of being manufactured and sold in kit form and the indicated drapery material may be added to conceal the shutters. The shutters may also be ornamentally surfaced, varnished, painted to match walls, covered with fabric to match upholstery, carpet covered, veneered, corked, plastic coated, etc. The various parts of the assembly are either available as standard parts or are readily manufacturable. The materials of construction may be of wood, metal, fabric and synthetic organic polymers, such as polyvinyl chloride, polystyrene, nylon, polyethylene, polypropylene, fiberglass-reinforced polyesters or other suitable synthetic organic polymers of the types generally known as "plastics". In most cases it will be desirable for the shutter material and preferably also for other materials employed in the practice of this invention to have low thermal conductivities, such as less than one B.t.u./(hr.) (sq. ft.) (°F.) (ft.), preferably less than 0.2 and most preferably less than 0.1 B.t.u./(hr.) (sq. ft.) (°F.) (ft.) for solid materials, and less than 0.5, preferably less than 0.1 and most preferably less than 0.02 B.t.u./(hr.) (sq. ft.) (°F.) (ft.) for porous or foamed materials. In preferred embodiments of the invention parts will be of synthetic organic polymer, preferably in porous form, or wood (with the possible exception of fasteners, such as screws, nails, etc.). The track members are very desirably of plastic materials although metals may be employed, especially if they are well lined with non-conductive sealing means, such as porous plastics or elastomers. Even the lock may be of plastic material, including the spring or similar part. Wood shutters of a thickness from 1 to 2 cm. are satisfactory, as are plastic shutters of the same or greater thickness or of a thickness as little as 0.5 cm. if hollow or of closed fine cell structure. Utilizing the preferred materials it is possible to diminish energy losses in a home at least 10% and sometimes up to 30% by utilization of the present shutters. Often the shutters may provide additional protection against energy losses despite previous installation of storm windows. Where storm windows have not been installed the present shutters can to a significant extent take their place and additionally will provide increased security for the premises.

Although various features of the invention contribute to its improved utility three such are worthy of special mention at this time. The preferred single track structure, although it may be replaced by an appropriate double track arrangement and even by double shutters (a pair or more in each track) is simple to install, cheap to manufacture and trouble-free. The locking feature on the shutters provides reproducible locating thereof and security against unauthorized entry (of course other types of locks and fasteners can also be employed). The seals provided inhibit or prevent leakage by convection and conduction and additionally, when the shutters are opaque, as they normally are, and especially if they are covered with a reflective material, diminish radiation losses too. The combination of the locking means and the sealing means, sealing against the vertical window frame parts and between the shutters (and the horizontal seals, too), holds sealing portions of the shutters tightly in place, preventing air circulation and energy losses.

Although preferred embodiments of the invention have been described herein it will be possible to utilize substitutes and equivalents without departing from the spirit of the invention. For example, instead of utilizing molded or extruded polymeric plastic tracks, metal tracks, such as aluminum extrusions, may be employed and instead of having the shutters ride inside U-shaped tracks the tracks employed may be J-shaped or of other suitable forms, with the shutters riding on rollers in said tracks and being sealed to other surfaces thereof. Fabric and extruded rubber weatherstripping may be utilized instead of porous polymeric materials. All such and various other modifications of the invention are within its scope, as will be apparent to one of skill in the art with the present teaching before him.

What is claimed is:

1. A sliding drapery covered shutter assembly for insulating a window and for securely closing a window opening about such window which comprises upper and lower track members, at the inside top and bottom of the window, respectively, a sliding shutter, slidable in said track members to open and closed positions, in the open position of which access may be had to the window from the inside and in the closed position of which the shutter closes off said window and maintains an insulating dead air space about it, which shutter is covered on the inside by a drapery member which is slidable with it and which exerts an additional insulating effect.

2. A shutter assembly according to claim 1 wherein only single tracks are provided and there is present a pair of shutters, both of which are slidable together between the tracks to a closed position and are slidable away from each other to open position, said shutters and the tracks for them being located inside the window, and said shutters both being covered by drapery members of thermally non-conductive material(s), fastened to them, concealing them and providing additional insulation.

3. An inside sliding shutter assembly according to claim 2, installed on a window.

4. A shutter assembly according to claim 2 wherein the tracks are mounted horizontally on a wall in which the window is set or on the window frame and/or sill or on a combination thereof and extend beyond the window on each side about half the width of the window frame and in which there are provided sealing means in or on the track members and/or the shutters so as to inhibit air movement past upper and lower parts of the shutters from an area near the window when the shutters and the covering drapery members are in closed position, while allowing sliding movement of the shutters in the tracks, with the covering drapery members, when desired, and sealing means on the shutter and/or window frame or bounding wall for the window to inhibit such air movement past the shutters when in closed position while still allowing sliding movement of the shutters and the covering drapery members when desired.

5. A shutter assembly according to claim 4 wherein locking means are provided for selectively holding the shutters in closed position.

6. A shutter assembly according to claim 5 wherein the tracks include resilient sealing means and are of U-shape with open sides thereof facing each other.

7. A shutter assembly according to claim 6 wherein the shutters are of thermally non-conductive material and include sealing means adapted to press against vertical window frames when the shutters are closed.

8. A shutter assembly according to claim 7 wherein the tracks, locking mechanism and sealing means are of thermally non-conductive material(s).

9. A shutter assembly according to claim 8 wherein a pair of shutters rides in single upper and lower tracks and the tracks have stops at the ends thereof to prevent accidental removal of shutters when the shutters are being opened.

10. A shutter assembly according to claim 9 wherein the locking means are held to a lower track and are adapted to fit into openings in the shutters to hold them in closed position.

* * * * *